US007267045B2

(12) United States Patent
Leweux et al.

(10) Patent No.: US 7,267,045 B2
(45) Date of Patent: Sep. 11, 2007

(54) INTERNAL COMBUSTION ENGINE

(75) Inventors: Johannes Leweux, Esslingen (DE); Wolfgang Pellkofer, Herrieden (DE); Harald Pfeffinger, Tiefenbronn (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 11/489,247

(22) Filed: Jul. 19, 2006

(65) Prior Publication Data

US 2006/0278071 A1 Dec. 14, 2006

Related U.S. Application Data

(63) Continuation-in-part of application No. PCT/EP2004/013603, filed on Dec. 1, 2004.

(30) Foreign Application Priority Data

Jan. 20, 2004 (DE) ..... 10 2004 002 759

(51) Int. Cl.
*F02F 1/20* (2006.01)
*F01M 3/00* (2006.01)

(52) U.S. Cl. ..... 92/159; 92/153; 384/293

(58) Field of Classification Search ..... 92/153, 92/158, 159; 91/46; 384/293
See application file for complete search history.

(56) References Cited

U.S. PATENT DOCUMENTS

| | | | | |
|---|---|---|---|---|
| 2,085,976 | A * | 7/1937 | Heintz | 92/153 |
| 2,809,873 | A * | 10/1957 | Cavileer | 92/153 |
| 3,063,763 | A * | 11/1962 | Zubrisky | 384/13 |
| 3,657,078 | A | 4/1972 | Schweikher | |
| 3,909,087 | A * | 9/1975 | Cairns | 384/293 |
| 5,516,213 | A * | 5/1996 | Moriyama et al. | 384/292 |
| 5,630,953 | A * | 5/1997 | Klink | 219/121.69 |
| 6,095,690 | A * | 8/2000 | Niegel et al. | 384/293 |

FOREIGN PATENT DOCUMENTS

| | | |
|---|---|---|
| DE | 43 16 012 | 11/1994 |
| EP | 1 275 864 | 1/2003 |
| GB | 2 340 547 | 11/1998 |

* cited by examiner

*Primary Examiner*—Thomas E. Lazo
(74) *Attorney, Agent, or Firm*—Klaus J. Bach

(57) ABSTRACT

In an internal combustion engine for a motor vehicle, having a piston bearing surface divided into regions of different loading and having recesses for retaining lubricant arranged at distances which are shorter in regions of high loading than in regions of lower loading in a region with high loading, the distance between the recesses decreases from one recess to the next in the direction toward top dead center area with the smallest distance being at the top dead center position of the piston.

5 Claims, 1 Drawing Sheet

INTERNAL COMBUSTION ENGINE

This is a Continuation-in-Part Application of International Patent Application PCT/EP2004/013603 filed Dec. 1, 2004 and claiming the priority of German Patent Application 10 2004 002 759.5 filed Jan. 20, 2004.

BACKGROUND OF THE INVENTION

The invention relates to an internal combustion engine having a piston with a bearing surface with different load areas formed by recesses arranged at varying distances.

German patent DE 43 16 012 C2 has disclosed a process which can be used to produce recesses in the piston bearing surface of an internal combustion engine. These are linear recesses which are arranged in sub-regions of the work piece surfaces in rows of constant spacing. Lubricant collects in the recesses, thereby to ensure a uniform and sufficient supply of lubricant. In regions which are subject to particularly high levels of wear there is a smaller spacing between the rows of recesses than in adjoining regions.

It is an object of the present invention to provide an arrangement of recesses which allows the lubricant supply to be matched more individually to the loading of the piston bearing surfaces.

SUMMARY OF THE INVENTION

In an internal combustion engine for a motor vehicle, having a piston bearing surface divided into regions of different loading and having recesses for retaining lubricant arranged at distances which are shorter in regions of high loading than in regions of lower loading in a region with high loading, the distance between the recesses decreases from one recess to the next in the direction toward top dead center area with the smallest distance being at the top dead center position of the piston.

The arrangement advantageously ensures individual adapting of the lubricant supply. At the top dead center, the recesses are very close together, i.e. a large amount of lubricant is available to cover the high loading on piston and piston bearing surface. The loading is composed of thermal and mechanical loading. The loading decreases in the direction of the bottom dead center, and accordingly the distances between the recesses increase in the direction of movement of the piston. This prevents an over-supply of lubricant, which is detrimental in terms of lubricant consumption and exhaust emissions. The recesses may be of any desired shape, for example round, polygonal, irregular or elongate. Equally, the recesses may have a different width/height ratio and a different depth. Furthermore, a variation in these geometric variables can be used to control the supply of lubricant.

In a particular embodiment of the invention, the recesses are arranged in rows that are spaced apart from one another. The recesses are arranged in parallel rows in the circumferential direction of the piston bearing surface. The rows are oriented at right angles or at a predetermined angle to the center axis of the cylinder bore. The distance between the recesses in the circumferential direction is preferably constant but can also be varied as required.

In a further configuration of the invention, the recesses in a row are circumferentially offset with respect to the adjacent rows. This advantageously makes it possible to realize uniform wetting of the piston bearing surface with lubricant.

In another configuration of the invention, there is an overlap between the recesses as seen in the direction of movement of the piston. In the circumferential direction, the length of the recesses is such that an overlap between the adjacent recesses is possible in the direction of movement of the piston. This arrangement ensures that recesses cover every location on the piston ring system during an upward or downward movement of the piston, and the piston bearing surface is wetted over the whole circumference thereof.

In a further configuration of the invention, the recesses are arranged helically on the bearing surface, the pitch of the helix decreasing in the direction toward the top dead center. The recesses are arranged on a line which extends as a helix over the piston bearing surface. The distance from one recess located on the line to the next recess located on the line can be varied as required. If only a small number of recesses is required to hold lubricant, because of a low loading, the helix pitch is large. At increasing proximity to the top dead center, the loading on the piston bearing surface and the piston increases, and therefore the demand for lubrication rises and more recesses are required in this region. For this purpose, the pitch of the helix is reduced by a decrease in the pitch angle.

In a further configuration of the invention, the recesses are stochastically distributed and the distribution density increases in the direction of the top dead center. The number of recesses is related to the demand for lubricant. An irregular, random recess allows the use of methods which do not lead to any particular accuracy in the positioning of the recesses.

In a further configuration of the invention, in the region of medium loading, the distances between the recesses are constant. If the loading on the piston bearing surface in a region is virtually constant, the recesses can be arranged at constant intervals.

In a further configuration of the invention, there are no recesses in the region of low loading. The lubricant particles which have collected in the surface structure are sufficient for lubrication in a piston bearing surface region which is subject to low loading. Therefore, it is possible to provide no recesses in order to reduce costs.

The invention will become more readily apparent from the following description thereof with reference to the accompanying drawings. Exemplary embodiments of the invention are illustrated in simplified form in the drawings and explained in more detail in the description:

DESCRIPTION OF PREFERRED EMBODIMENTS

Figure 1:
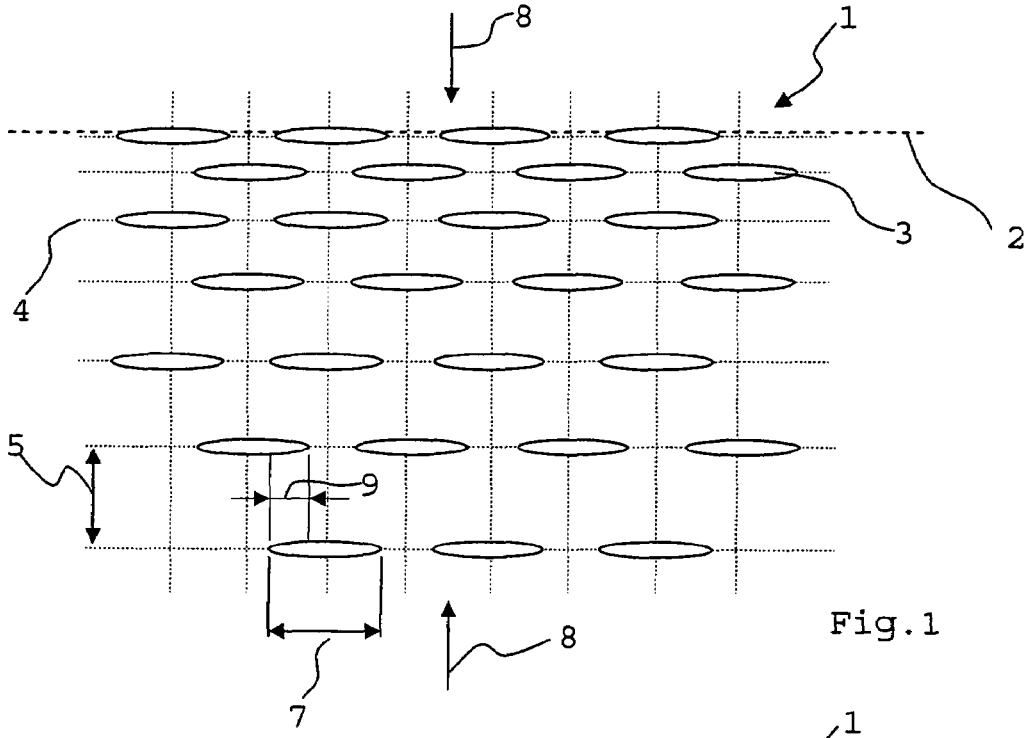
FIG. 1 diagrammatically depicts a partial developed view of a first embodiment showing a piston bearing surface according to the invention.
Figure 2:
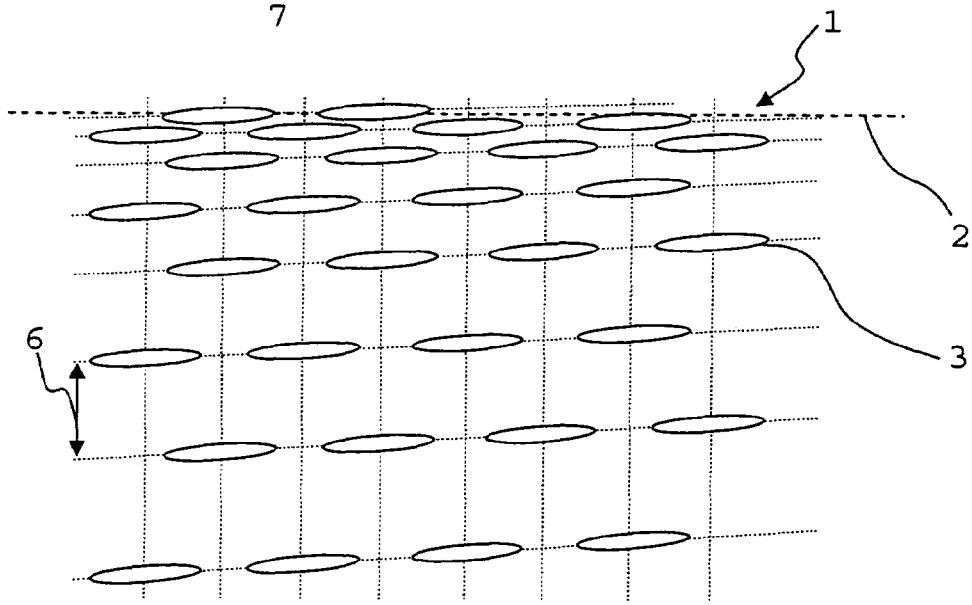
FIG. 2 shows a second exemplary embodiment, illustrating a partial developed view of a piston bearing surface according to the invention.

Identical components or identical apparatus features in FIGS. 1 and 2 are denoted by the same reference designations.

Internal combustion engines convert the energy contained in the fuel into heat and mechanical work at a crank shaft in a working process involving combustion. The combustion operation takes place within the working space formed by the piston, the piston bearing surface 1 and the cylinder head of an internal combustion engine.

FIG. 1 diagrammatically depicts part of a developed view of the piston bearing surface 1. A piston (not shown) moves on the bearing surface between a top dead center 2 and a bottom dead center position (not shown).

To seal the piston with respect to the piston bearing surface 1, the piston has a piston ring system which bears in sliding fashion against the piston bearing surface 1. The top dead center 2 illustrated in the drawing is to be understood as being the reversal point of a piston ring of the piston ring system which faces the cylinder head. To ensure good lubrication conditions, the piston bearing surface 1 must be constantly wetted with lubricant. For this purpose, recesses 3 which are intended to hold lubricant are arranged in the piston bearing surface 1. As a result of lubricant being held in the recesses 3, local pressure cushions are formed between the piston with piston rings and the piston bearing surface 1, with the result that the coefficient of friction and the wear rates are advantageously reduced. The shape of the recesses 3 illustrated in the figures is just an example, and it is fundamentally possible to use recesses 3 of any desired shape to hold lubricant. The most favorable shape of the recesses 3 can be adapted to the options in terms of the manufacturing process used, such as for example mechanical machining, laser machining, a chemical etching process or a high-pressure water jet process.

While the engine is operating, there are different loadings over the stroke length of the piston, i.e. between the top and bottom dead centers. High loading occurs in the region of the top dead center 2. Pressure and temperature are rising in the working space during a compression of an air/fuel mixture. Then a spark ignition or compression ignition of the mix with subsequent expansion of the combustion gas takes place just before the top dead center position 2. This region of high loading is illustrated in FIG. 1 to FIG. 3. In the exemplary embodiment, the highly loaded region covers the top third of the piston bearing surface 1 adjoining the dead center location 2. Of course, the region provided with a certain distribution of the recesses 3 corresponding to the loading encountered can be selected to be larger or smaller.

As shown in FIG. 1, the recesses 3 are arranged in rows 4. The rows 4 are at a distance from one another which decreases from one row 4 to the next in the direction of the top dead center 2. The decrease in the distances 5 between the rows is substantially determined by the demand for lubricant. For example, the distance 5 between the rows, in the direction of the dead center 2, may in each case be half the distance of a previous distance 5 between the rows, but it is equally possible to work on the basis of any other mathematical function to describe the reduction in distance.

Accordingly, the distance 5 between the rows is shortest adjacent the dead center location 2, i.e. in the region, which is subject to the highest loading, a sufficient supply of lubricant is ensured. At an increasing distance from the top dead center location 2, the demand for lubricant decreases, which means that the distances 5 between the rows increase accordingly. This advantageously avoids combustion of excess lubricant, which unnecessarily increases lubricant consumption and also has an adverse affect on the exhaust emissions, e.g. particulate emissions or HC emissions.

The length 7 of the recesses 3 is selected in such a way that, in the direction of movement 8 of the piston, the recesses 3 have an overlap 9. This ensures that a lubricating film can form over the entire circumference of the piston bearing surface 1.

In the embodiment shown in FIG. 2, the recesses 3 are arranged on a helix with a pitch 6. The pitch 6 decreases in the direction of the top dead center 2, with a simultaneous reduction in the pitch angle, so that the distances between the recesses 3 decrease. This takes account of an increasing demand for lubricant in the area of the top dead center 2.

It is also possible to provide a random distribution of recesses 3, the density of which increases toward the top dead center 2. This distribution is suitable, for example, for a process which does not permit accurate positioning of the recesses 3. The recesses 3 are irregularly distributed in the circumferential direction. The recesses are likewise arranged irregularly in the direction of movement 8 of the piston, but the density of the recesses increases in the direction of the top dead center 2.

In a modified exemplary embodiment, asymmetrically shaped recesses 3 are not oriented in one direction, but rather adopt any desired position with respect to one another.

In the direction of the bottom dead center 2, the region of high loading is followed by a region of medium loading (not shown) and a region of low loading. These each have a length of, for example, one third of the total length of the piston bearing surface 1. In the region of medium loading, the recesses 3 are arranged in rows 4 with a constant spacing. This makes it possible to realize a collection of lubricant in the recesses 3 which corresponds to the demand for lubrication.

No recesses 3 are provided in a region with low loading.

The recesses 3 are superimposed on the striations produced in the piston bearing surface 1 by a honing process. Therefore, the honing striations ensure a basic supply of lubricant based on the demand of a region with low loading. The provision of recesses 3 as shown in FIG. 1 to FIG. 3 can be used to realize a targeted supply of lubricant to regions which are subject to higher loading.

Of course, the piston bearing surface 1 can also be divided into any desired number of loading regions, in which case each sub-region may have recesses 3 of any desired geometry in accordance with an arrangement shown in the figures or an arrangement in rows 4 with a constant distance between them. It is also possible to provide regions which do not have any recesses 3.

The invention claimed is:

1. An internal combustion engine for a motor vehicle, having:

a piston bearing surface (1) divided into regions of different loading, the piston bearing surface regions delimited by a top dead center piston location (2) and being provided with recesses (3) for holding lubricant, the distances between the recesses being shorter in regions of high loading than in regions of lower loading, and in a region with high loading the distance between the recesses (3) decreasing from one recess (3) to the next in the direction toward the top dead center location (2), so that the distances are smallest at the top dead center location (2) and in a region of medium loading the distances between the recesses (3) are constant, said recesses (3) being stochastically distributed and the distribution density increasing toward the top of the dead center location.

2. An internal combustion engine for a motor vehicle, having:

a piston bearing surface (1) divided into regions of different loading, the piston bearing surface regions being delimited by a top dead center piston location (2) and being provided with recesses (3) for holding lubricant, the distances between the recesses being shorter in regions of high loading than in regions of lower loading, and in a region with high loading the distance between the recesses (3) decreasing from one recess (3) to the next in the direction toward the top dead center location (2), 50 that the distances are smallest at the top dead center location (2), said recesses (3) being arranged helically on the bearing surface, the pitch (6) of the helix decreasing toward of the top dead center (2).

3. The internal combustion engine as claimed in claim 2, wherein, in the region of medium loading, distances between the recesses (3) are constant.

4. The internal combustion engine as claimed in claim 2, wherein there are no recesses (3) in the region of low loading.

5. An internal combustion engine for a motor vehicle, having:

a piston bearing surface (1) divided into regions of different loading, the piston bearing surface regions delimited by a top dead center piston location (2) and being provided with recesses (3) for holding lubricant arranged at distances from one another which are shorter in regions of high loading than in regions of lower loading, and in a region with high loading the distance between the recesses (3) decreasing from one recess (3) to the next in the direction toward the top dead center location (2), so that the distances are smallest at the top dead center location (2) and in a region of medium loading the distances between the recesses (3) are constant, said recesses (3) being stochastically distributed and the distribution density increasing toward the top the dead center location and no recesses (3) being provided in a region of low loading.

* * * * *